US006962634B2

(12) United States Patent
Nielson et al.

(10) Patent No.: US 6,962,634 B2
(45) Date of Patent: Nov. 8, 2005

(54) LOW TEMPERATURE, EXTRUDABLE, HIGH DENSITY REACTIVE MATERIALS

(75) Inventors: Daniel B. Nielson, Tremonton, UT (US); Richard M. Truitt, North Ogden, UT (US); Nikki Rasmussen, Logan, UT (US)

(73) Assignee: Alliant Techsystems Inc., Edina, MI (US)

( * ) Notice: Subject to any disclaimer, the term of this patent is extended or adjusted under 35 U.S.C. 154(b) by 0 days.

(21) Appl. No.: 10/386,617

(22) Filed: Mar. 12, 2003

(65) Prior Publication Data

US 2004/0020397 A1 Feb. 5, 2004

Related U.S. Application Data

(60) Provisional application No. 60/368,284, filed on Mar. 28, 2002.

(51) Int. Cl.[7] ..... C06B 45/10
(52) U.S. Cl. ..... 149/19.3; 102/476; 102/306
(58) Field of Search ..... 149/19.3; 102/473, 102/476, 307, 306

(56) References Cited

U.S. PATENT DOCUMENTS

| | | | | |
|---|---|---|---|---|
| 3,669,020 | A | 6/1972 | Waite et al. | |
| 3,978,796 | A | 9/1976 | Hackman | |
| 4,011,818 | A | 3/1977 | Stosz, Jr. et al. | |
| 4,029,868 | A | 6/1977 | Carlson | |
| 4,037,539 | A | 7/1977 | Hackman | |
| 4,131,498 | A | 12/1978 | Lucy | |
| 4,179,992 | A * | 12/1979 | Ramnarace et al. | 102/470 |
| 4,432,816 | A * | 2/1984 | Kennedy et al. | 149/19.3 |
| 4,655,139 | A | 4/1987 | Wilhelm | |
| 4,693,181 | A * | 9/1987 | Dadley et al. | 102/307 |
| H540 | H | 11/1988 | Caponi | |
| 4,807,795 | A | 2/1989 | LaRocca et al. | |
| 5,055,539 | A | 10/1991 | Hengel et al. | |
| 5,259,317 | A | 11/1993 | Lips | |
| H1504 | H | 12/1995 | Crabtree | |
| 5,531,844 | A | 7/1996 | Brown et al. | |

(Continued)

FOREIGN PATENT DOCUMENTS

| | | |
|---|---|---|
| DE | 102 24 503 A | 12/2002 |
| GB | 588 671 A | 11/1944 |
| GB | 968 507 A | 11/1960 |
| WO | WO 96/07700 A | 3/1996 |
| WO | WO 02/00741 A | 1/2002 |

OTHER PUBLICATIONS

Hackh's Chemical Dictionary, 4th Ed., Dec. 4, 1974, p. 663.*
Partial European Search Report dated Jul. 20, 2004.
DuPont Fluoropolymers, Food Processing and Industrial Bakeware Coatings, http://www.dupont.com/teflon/bakeware/power.html, Copyright © 2003 E.I. duPont de Nemours and Company.

(Continued)

*Primary Examiner*—Aileen Felton
(74) *Attorney, Agent, or Firm*—TraskBritt

(57) ABSTRACT

A reactive material for use as a reactive liner in penetrating (shape-charge) warheads and for use in reactive fragments in fragmenting warheads is disclosed. The reactive material comprises an oxidizing agent and a metal filler or metal/metal oxide filler. The oxidizing agent comprises a fluoropolymer having high fluorine content, a low melt temperature, and a high mechanical strength. Preferably, the fluoropolymer is a thermoplastic fluoropolymer, such as a polymer of tetrafluoroethylene, hexafluoropropylene, and vinylidene fluoride. The metal filler comprises a high density, reactive metal. Preferably, the metal filler is hafnium or tantalum. The reactive material is safely processed at temperatures significantly below the thermal autoignition point of the reactive material.

24 Claims, 8 Drawing Sheets

U.S. PATENT DOCUMENTS

| | | | | | |
|---|---|---|---|---|---|
| 5,549,948 | A | | 8/1996 | Blong et al. | |
| 5,710,217 | A | | 1/1998 | Blong et al. | |
| 5,792,977 | A | * | 8/1998 | Chawla | 102/307 |
| 5,886,293 | A | | 3/1999 | Nauflett et al. | |
| 6,308,634 | B1 | | 10/2001 | Fong | |
| 6,371,219 | B1 | * | 4/2002 | Collins et al. | 175/2 |
| 6,427,599 | B1 | * | 8/2002 | Posson et al. | 102/336 |
| 6,588,344 | B2 | * | 7/2003 | Clark et al. | 102/307 |

OTHER PUBLICATIONS

DuPont Teflon®, Industrial Coatings, http://www.dupont.com/teflon/coatings/basic_types.html, Copyright © 2003 E.I. duPont de Nemours and Company.

Zumdahl, Steven S., *Chemistry*, Polymers, pp. 931–934, (no date).

* cited by examiner

LOW TEMPERATURE, EXTRUDABLE, HIGH DENSITY REACTIVE MATERIALS

CROSS-REFERENCE TO RELATED APPLICATIONS

This application claims the benefit of U.S. Provisional Patent Application Ser. No. 60/368,284, filed Mar. 28, 2002, for LOW TEMPERATURE EXTRUDABLE, HIGH DENSITY REACTIVE MATERIALS.

BACKGROUND OF THE INVENTION

1. Field of the Invention

This invention relates generally to a reactive material suitable for use as a shape-charge liner in a penetrating warhead and in reactive fragments in a fragmentary warhead. More specifically, the invention relates to a reactive material comprising a fluoropolymer and a metal filler. This reactive material is capable of being safely processed at temperatures significantly below the thermal autoignition point of the reactive material.

2. State of the Art

A penetrating warhead 2 used in a projectile or missile typically comprises a case 4, an explosive material 6, an initiator, and a liner 8, as shown in FIG. 1A. The case 4 is generally a cylindrical tube comprised of steel, plastic, or a composite material. At least a portion of the case 4 is typically filled with the explosive material 6. When the explosive material 6 in the warhead 2 is detonated, the liner 8 forms a high-velocity jet that has a high kinetic energy capable of penetrating solid objects, such as a target. The liner 8 is formed from a solid material that is formed into a jet responsive to detonation of the explosive charge. The liner material is typically a high density, ductile material, such as a metal, a metal alloy, a ceramic, or a glass. The metals commonly used in liners include copper, aluminum, depleted uranium, tungsten, or tantalum. In addition to penetrating warheads 2, fragmentary warheads 10 are commonly used. As illustrated in FIG. 1B, the fragmentary warhead 10 typically comprises fragments 12 of material that are projected at a target upon detonation of the explosive material 6 of the warhead 10. The fragments 12 must be able to withstand the explosive force of the detonation, otherwise the force commonly breaks up the fragments, thereby reducing their ability to penetrate the target.

Depending on the mechanical strength characteristics of the target, penetration by the liner 8 or fragments 12 may heavily damage or destroy the target. However, if the target is an armored vehicle or other heavily armored target, the liner 8 or fragments 12 may not cause the desired degree of damage. To improve the destructive capability of the warhead, the liner 8 or fragments 12 may be provided with the ability to produce secondary reactions that cause additional damage. These secondary reactions commonly include incendiary reactions. As disclosed in U.S. Pat. No. 4,807,795 to LaRocca et al., pyrophoric metals are added to the liner to provide the desired incendiary effects. In LaRocca et al., a double-layered liner is disclosed, where a layer of dense metal provides the penetration ability and a layer of light metal, such as aluminum or magnesium, produces the incendiary effects.

While metals have been commonly used in liners, reactive materials have also been used. As known in the art and used herein, the term "reactive material" refers to a material comprising a metal that reacts with an oxidizing agent. Upon impact with a target, the reactive material of the liner produces a high burst of energy. A known reactive material includes an aluminum and polytetrafluoroethylene ("PTFE") material, referred to herein as an "Al/PTFE" reactive material. PTFE is available from DuPont under the tradename TEFLON®. PTFE has the highest fluorine content of all fluoropolymers, is the most resistant fluoropolymer to chemical attack, and requires high processing temperatures to achieve its maximum strength. PTFE is used in reactive materials because its high fluorine content makes it a strong oxidizing agent. The Al/PTFE reactive material has good penetration ability in light armor or thin-skinned targets, such as aircraft, due to the density of the aluminum. The Al/PTFE reactive material also provides incendiary reactions because the reactive material ignites upon penetration into the target.

To form Al/PTFE high strength components, such as reactive fragments 12 for fragmentary warheads 10, the reactive material is pressed into billets or pressed preforms. The pressed preforms are then sintered and annealed at high temperatures, typically 350–390° C. Due to PTFE's high melting temperature of 342° C., these high sintering temperatures are necessary to form reactive materials using PTFE. The currently preferred technique for forming Al/PTFE fragments comprises blending the PTFE and aluminum in a solvent. The solution of Al/PTFE is spread on a tray and dried in an oven. The dried composition is then conditioned to 185° F. and pressed in a 185° F. heated die. The pressed preform is then heated to 350–390° C. for sintering. Since the PTFE is highly viscous at this temperature range, it maintains its approximate shape. The sintered preform is then cooled at a set rate to minimize cracking and maximize the mechanical properties of the Al/PTFE reactive material. The mechanical properties of the Al/PTFE reactive material are inversely related to the degree of crystallinity in the PTFE. In general, high crystallinity in the PTFE results in low tensile strength and high elongation. The current processing techniques available to form high strength components from Al/PTFE are limited due to PTFE's high viscosity at the 350–390° C. temperatures required for sintering.

To further increase the penetration ability of warheads, reactive materials comprising PTFE and metals with a higher density than aluminum have been produced. These higher density metals included tantalum and tungsten, which are more chemically reactive with PTFE at the sinter temperatures than aluminum. These Ta/PTFE and W/PTFE reactive materials were processed, using the same conditions as the Al/PTFE reactive material, to form 3.5-inch diameter and 1-inch diameter pucks. However, under these reaction conditions, the Ta/PTFE and W/PTFE reactive materials exhibited undesirable grain cracking resulting from volatile chemical reactions during the sintering process. The tungsten and tantalum reacted with trace amounts of hydrofluoric acid ("HF") present at the temperatures used during the sintering process to produce highly volatile reaction products. The Ta/PTFE reactive material formed volatile tantalum fluoride compounds that were extremely exothermic. Accelerated Rate Calorimetry ("ARC") testing of the Ta/PTFE material revealed an exotherm that occurred at only a few degrees higher than the sintering temperature. This exotherm occurred at 375° C. In addition, the strong exothermic reaction caused the Ta/PTFE reactive material to autoignite at 307° C. during an experimental sinter cycle. The W/PTFE reactive material off-gassed during the sintering process due to the formation of highly volatile tungsten fluoride compounds (such as $WF_6$ and $WOF_4$) that caused severe cracking of the pressed preforms. These highly exothermic reactions raised concerns regarding the safety of processing the Ta/PTFE reactive materials at the high temperatures necessary to process PTFE. The highly exothermic reactions also raised concerns regarding the quality of the W/PTFE reactive materials due to the observed cracking.

Reactive materials comprising a metal and a fluoropolymer have also been used in military pyrotechnics. In U.S. Pat. No. 5,886,293 to Nauflett et al., a process of producing energetic materials for use in military pyrotechnics is disclosed. The energetic material comprises a magnesium fluoropolymer, specifically magnesium/TEFLON®/Viton® ("MTV"). Viton® is a copolymer of vinylidenefluoride-hexafluoropropylene. The resulting energetic material is used to produce rocket motor igniters and aircraft decoy flares.

In light of the processing and safety problems associated with Ta/PTFE and W/PTFE reactive materials, it would be highly desirable to develop a reactive material having a high penetration ability that can be safely processed at temperatures lower than the 350–390° C. temperatures required to process PTFE. Ideally, the desired reactive material would be processed at temperatures below the autoignition temperature at which volatile metal fluoride compounds form.

BRIEF SUMMARY OF THE INVENTION

The present invention relates to a reactive material comprising at least one metal filler and an oxidizing agent. The oxidizing agent comprises a fluoropolymer having a high fluorine content, a low melt temperature, and a high mechanical strength. Preferably, the fluoropolymer is a thermoplastic fluoropolymer, such as a polymer of tetrafluoroethylene, hexafluoropropylene, and vinylidene fluoride. The metal filler comprises a high density, reactive metal, such as hafnium, tantalum, magnesium, titanium, tungsten, aluminum, magnesium/aluminum alloys, or zirconium. The metal filler may be a metal/metal oxide filler or an intermetallic filler. The reactive material is processed at temperatures significantly below the thermal autoignition point of the reactive material.

The present invention also relates to an article, such as a warhead, comprising the reactive material.

In addition, the present invention relates to a method of safely processing a reactive material. The method comprises mixing at least one metal filler with an oxidizing agent to form the reactive material. The reactive material is then processed at a temperature below the thermal autoignition point of the reactive material.

BRIEF DESCRIPTION OF THE DRAWINGS

While the specification concludes with claims particularly pointing out and distinctly claiming that which is regarded as the present invention, the advantages of this invention can be more readily ascertained from the following description of the invention when read in conjunction with the accompanying drawings in which:

DETAILED DESCRIPTION OF THE INVENTION

Figure 1A:
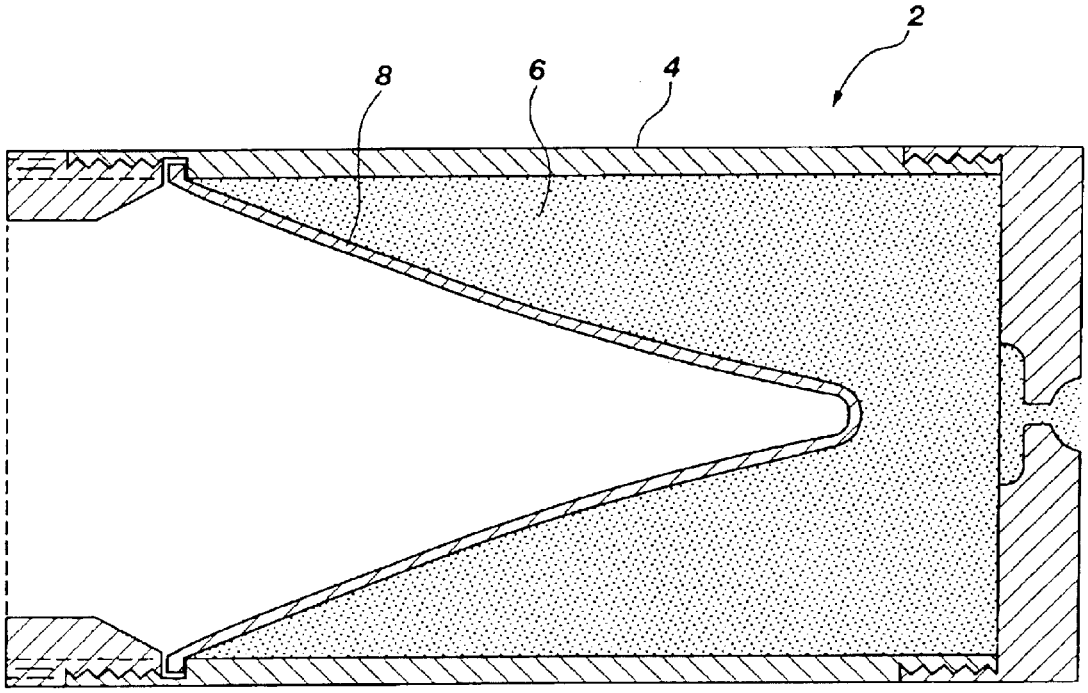
FIGS. 1A and 1B schematically illustrate a penetrating warhead and a fragmentary head.
Figure 1B:
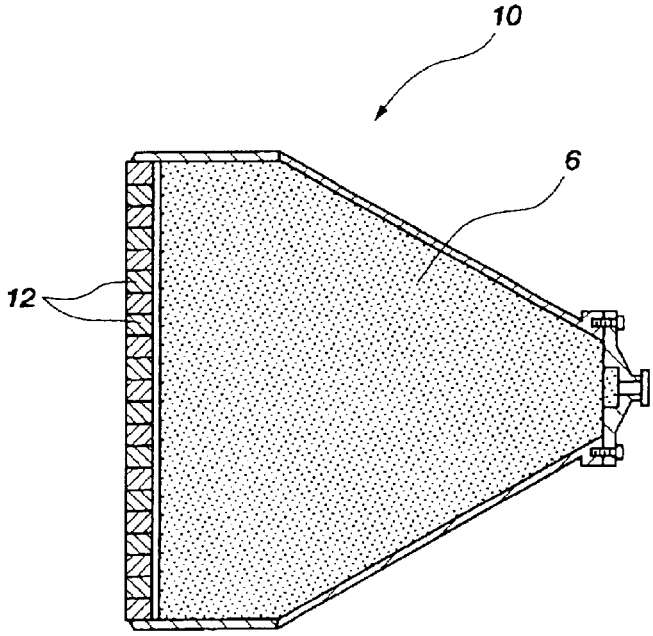

The reactive material of the present invention may be used as a reactive liner 8 in penetrating (shape-charge) warheads 2 and in high strength reactive fragments 12 in fragmentary warheads 10, as illustrated in FIGS. 1A and 1B. The reactive material comprises an oxidizing and at least one metal filler and may be safely processed at temperatures significantly below the thermal autoignition point of the reactive material. The reactive fragments 12 and reactive liners 8 are able to penetrate solid targets and produce incendiary effects after the fragments/liners have penetrated the target, thereby increasing the destructive effect of the warheads.

The oxidizing agent may provide strength to the reactive material so that the reactive material survives detonation of the warhead. In addition, the oxidizing agent may be a strong oxidizer so that secondary reactions, such as incendiary reactions, occur when the reactive material penetrates its target. The incendiary reactions may also be due to afterburning of the metal filler, which is caused by a reaction between the metal filler and atmospheric oxygen. The oxidizing agent may accelerate the rate of metal filler/atmospheric oxygen reaction. Preferably, the oxidizing agent is a fluoropolymer or fluoroelastomer with a high fluorine content, a low melt temperature, and a high mechanical strength. More preferably, the oxidizing agent is a thermoplastic fluoropolymer.

The high mechanical strength of the fluoropolymer may provide the reactive material with the strength to survive the detonation or explosive launch of the warhead. The mechanical strength of the fluoropolymer may be particularly important in fragmentary warheads 10 because coherent fragments 12 must survive the detonation in order to impact the target. The high fluorine content of the fluoropolymer may provide the necessary oxidizing strength to produce incendiary reactions with the metal filler when the reactive material penetrates its target. The heat generated when the reactive material penetrates the target may cause the fluorines in the fluoropolymer to be liberated from the hydrocarbon chain of the fluoropolymer and to exothermically react with the metal filler. The low melt temperature of the fluoropolymer may help to ensure that the reactive material may be processed at a temperature below which the rate of metal reacting with trace amounts of HF is greatly reduced or eliminated.

By reducing the temperature at which the reactive material is processed, the safety concerns identified previously may be eliminated or greatly reduced. In order to improve the safety of processing the reactive materials, the melting temperature of the fluoropolymer may not exceed the autoignition temperature of the reactive material (the fluoropolymer/metal filler composition). In other words, the reactive material may not produce an exotherm or exotherms at or below the processing temperature. The processing temperature of the reactive metal may vary depending on the melting point of the fluoropolymer and the amount of metal filler present. To provide an adequate margin of safety, the processing temperature may be no higher than 50° C. below the thermal autoignition point of the reactive material or the temperature at which an exotherm occurs. However, depending on the acceptable degree of risk in processing the reactive materials, this 50° C. margin of error may be reduced as long as the melting temperature of the fluoropolymer does not exceed the autoignition temperature of the reactive material.

The fluoropolymer of the reactive material may be selected based on its low-temperature processing capability, cost, availability, fluorine content, mechanical properties of the unfilled fluoropolymer, melting point, viscosity at desired processing temperature, and compatibility of the fluoropolymer with reactive metal fillers. Properties of selected commercially available fluoropolymers are shown in Table 1. These fluoropolymers are available from Dupont, Dyneon LLC, and Asahi Glass Co., Ltd. The fluoropolymer of the present invention may include, but is not limited to, a thermoplastic terpolymer of tetrafluoroethylene, hexafluoropropylene, and vinylidene fluoride ("THV"), a thermoplastic copolymer of tetrafluoroethylene and perfluorovinylether ("PFA"), a thermoplastic copolymer of tetrafluoroethylene and ethylene ("ETFE"), or a thermoplastic copolymer of tetrafluoroethylene and hexafluoropropylene ("FEP").

In addition to using one fluoropolymer as the oxidizing agent, it is also contemplated that a combination of at least two fluoropolymers may be used. For sake of example only, a combination of PTFE and THV 220 or a combination of two different THV polymers may be used. At least two fluoropolymers may be present in percentages sufficient to provide the high fluorine content, the low melt temperature, and the high mechanical strength to the reactive material.

The fluorine content of the fluoropolymer is preferably greater than approximately 45% by weight. However, a fluoropolymer having a lower fluorine may be used depending on the mechanical properties of the fluoropolymer. In other words, a fluoropolymer having a fluorine content less than approximately 45% by weight may be used if the fluoropolymer has a high tensile strength and a high percentage of elongation, in addition to the desired low melt temperature.

Preferably, the fluoropolymer of the reactive material is THV 220, available from Dyneon LLC (Oakdale, Minn.), because THV 220 is easy to process due to its complete solubility in conventional solvents and its low melt temperature. THV 220 has a melt temperature of 222° C. below the melt temperature of PTFE. Conventional solvents include ketones and esters and, more specifically, acetone and ethyl acetate. The low melt temperature of THV 220 allows the reactive material to be processed at temperatures

TABLE 1

Properties of Selected Fluoropolymers

| Polymer | Tensile Strength (psi) at 23° C. | (%) Elongation at 23° C. | Melting Point (° C.) | Solubility | Fluorine Content (% by weight) |
|---|---|---|---|---|---|
| Polytetrafluorethylene | | | | | |
| PTFE (TEFLON ®) | 4500 | 400 | 342 | Insoluble | 76 |
| TFM 1700 Modified PTFE | 5800 | 650 | 342 | Insoluble | 76 |
| Fluoroelastastomers (Gums) | | | | | |
| Viton A (Fluorel 2175) | 2000 | 350 | 260 | Soluble in ketones/esters | 65.9 |
| FEX 5832X terpolymer | 2000 | 200 | 260 | Soluble in ketones/esters | 70.5 |
| Fluorothermoplastic Terpolymer of Tetrafluoroethylene, Hexafluoroproplyene, and Vinylidenefluoride | | | | | |
| THV 220 | 2900 | 600 | 120 | Soluble in ketones/ Esters (100%) | 70.5 |
| THV X 310 | 3480 | 500 | 140 | Soluble in ketones/esters (partial) | 71–72 |
| THV 415 | 4060 | 500 | 155 | Soluble in ketones/ esters (partial) | 71–72 |
| THV 500 | 4060 | 500 | 165 | Soluble in ketones/ esters (partial) | 72.4 |
| HTEX 1510 | 4800 | 500 | 165 | Insoluble | 67.0 |
| Fluorothermoplastic Copolymer of Tetrafluoroethylene and Perfluorovinylether | | | | | |
| PFA | 4350 | 400 | 310 | Insoluble | 76 |
| Fluorothermoplastic Copolymer of Tetrafluoroethylene and Hexafluoropropylene | | | | | |
| FEP | 2900–4300 | 350 | 260 | Insoluble | 76 |
| Fluorothermoplastic Copolymer of Tetrafluoroethylene and Ethylene | | | | | |
| ETFE | 6700 | 325 | 260 | Practically insoluble | 61.0 |

significantly below the thermal autoignition point using conventional batch mixers. THV 220 is further preferable because the sintering process required to produce PTFE reactive materials may be eliminated, thereby increasing production efficiency.

In addition to THV 220, other THV polymers including, but not limited to, THV X 310, THV 415, THV 500, and HTEX 1510, all available from Dyneon LLC, may be used as the fluoropolymer of the reactive material. The primary advantage offered by THV polymers is the significantly reduced process temperature and the elimination of the sintering process required in PTFE processing. Other fluoropolymers may also be used in the reactive material as long as these fluoropolymers have the desired properties of a high fluorine content, a low melt temperature, and a high mechanical strength.

The metal filler of the reactive material may be a reactive, high density metal that provides the requisite penetrating power and energy release for the warhead. The metal filler may be magnesium, aluminum, magnesium/aluminum alloys, iron, copper, zirconium, titanium, zinc, boron, silicon, manganese, tin, hafnium, tungsten, depleted uranium, or tantalum, or metal carbides, oxides, or nitrides of these metals. The metal filler may have a density that is approximately equal or greater than the density of magnesium (1.74 g/cm$^3$). In addition, the metal filler may be at least as reactive with the oxidizing agent as magnesium or aluminum. Preferably, the metal filler is hafnium, tantalum, magnesium, titanium, tungsten, aluminum, magnesium/aluminum alloys, or zirconium. The metal fillers may be combined with the reactive material in powdered form. However, intermetallic thermitic and incendiary mixes of the metal filler may also be used within the scope of the invention. The metal filler may also be a combination or blend of two or more of these metals. For example, the metal filler may be a blend of hafnium and tantalum. In addition, the metal filler may be a metal/metal oxide filler (a thermite), such as $Fe_2O_3$/aluminum, $Fe_2O_3$/zirconium, CuO/aluminum, $Fe_2O_3$/titanium, tantalum/iron oxide, manganese dioxide/aluminum, or other thermite compositions. Intermetallic fillers that include a blend of two or more of the metals may also be used. The intermetallic fillers may include a blend of unreacted metals that have differing numbers of molar ratios of each of the two or more metals, such as one mole of hafnium and two moles of aluminum; one mole of hafnium and one mole of aluminum; one mole of hafnium and two moles of boron; one mole of nickel and one mole of aluminum; one mole of titanium and one mole of aluminum; one mole of titanium and two moles of aluminum; one mole of zirconium and one mole of aluminum; one mole of zirconium and two moles of aluminum; one mole of molybdenum and two moles of aluminum; one mole of aluminum and two moles of boron; one mole of hafnium and two moles of boron; one mole of tantalum and one mole of boron; one mole of titanium and two moles of boron; one mole of zirconium and one mole of boron; or other intermetallic compositions may also be used.

The fluoropolymer may be present in the reactive material at approximately 15–90% by weight. Preferably, the fluoropolymer is present at approximately 25–75% by weight. The metal filler may be present at approximately 10–85% by weight.

The reactive material may be produced by mixing the fluoropolymer and the metal filler, as known in the art. If the fluoropolymer is soluble in ketones or esters, a particle size of the fluoropolymer may not be critical to the operability of the present invention. However, if the fluoropolymer is insoluble in ketones or esters, the fluoropolymer may be commercially obtained in milled form or may be processed to its milled form, as known in the art. The insoluble fluoropolyner preferably has a small particle size, such as an average particle size of approximately 1 micron. The fluoropolymer may then be combined with the metal filler and blended with a solvent to form a suspension of reactive material. A twin-screw extruder may also be used to compound or mix the metal filler with the fluoropolymer if solvents are undesirable. If the fluoropolymer is soluble in ketones or esters, the reactive material may be mixed by a solvent loss technique or a polymer precipitation technique, which are described in more detail below.

After the fluoropolymer and metal filler are mixed, the reactive material may be processed by pressing or extrusion to manufacture near-net-shape preforms. A reactive material comprising a fluoropolymer that is insoluble in ketones or esters may be directly pressed or extruded, as described below. A reactive material comprising a soluble fluoropolymer may be processed by the polymer precipitation or solvent loss techniques, followed by pressing or extrusion. If the reactive material is processed by pressing, the solution of reactive material is dried in an oven. The dried reactive material is then loaded into a die that is heated to approximately 165–180° C. This temperature is dependent on the melting point and the viscosity of the reactive material. Higher temperatures will be required to process reactive materials comprising fluoropolymers with higher melting points. The reactive material is melted under pressure (approximately 1500 psi) and under vacuum. This pressure is dependent on the rheology of the reactive material. The die is cooled to below the melt temperature of the die (approximately 80–100° C.) for several minutes. The pressing pressure is then increased to approximately 3000–4000 psi and the cooling of the die is continued to 50–60° C. It is essential that the die have a slow cooling rate to maximize polymer crystallinity and mechanical properties. Once the reactive material is adequately cooled, it is pressed from the die and allowed to cool to ambient room temperature.

If the reactive material is processed by extrusion, the solution of reactive material is dried in an oven. The dried reactive material is then loaded into an extruder heated to approximately 165–180° C. The reactive material is melted under pressure (approximately 1500 psi) and under vacuum. The pressure required to melt the reactive material is dependent on the fluoropolymer used in the reactive material and the metal content in the reactive material. The extrusion pressure is then increased to form an extrudate, which is then cut into pieces and allowed to cool to ambient room temperature.

It is also contemplated that these reactive materials may be used to allow near-net-shape fabrication of components using injection molding or extrusion, thereby reducing waste and machining time.

The processed reactive materials formed by either of these methods may be analyzed to determine the percentage of theoretical maximum density ("% of TMD") for each reactive material. The % of TMD is measured as known in the art. If the reactive material has a % of TMD equal to approximately 100%, it indicates that no voids are present in the reactive material. The desired % of TMD of the reactive material may range between approximately 80–100%. Preferably, the % of TMID of the reactive material is between approximately 90–100% and, more preferably, between approximately 95–100%. The desired % of TMD may depend on the ultimate application in which the reactive material may be used.

The reactive material having a sufficient % of TMD may be used in reactive fragments 12 for fragmentary warheads 10 or liners 8 in penetrating warheads 2. In a penetrating warhead 2, the reactive material may be machined, pressed, or extruded into a desired shape for use as the liner 8. In addition, the reactive material may be placed into a mold to produce the desired shape of the liner 8. For example, the reactive material is weighed into the desired quantity. TEFLON® tape is placed on a top surface of a first copper dish and a bottom surface of a second copper dish. The first copper dish is heated in a 170° C. oven. A TEFLON® brick is placed over the first copper dish and the reactive material is stacked into the middle of the first copper dish. The reactive material is heated for about 45 minutes or until it becomes easily pliable. The second copper dish is placed on top of the material and lightly pressed down, making sure that the alignment of the dish is flat. A TEFLON® donut is placed on top of the second copper dish and two metal weights are placed on top of the TEFLON® donut. The TEFLON® donut and metal weights are arranged so that the weight is pressing straight down on the reactive material to ensure that the reactive material will have a uniform thickness. The set-up is left for 45 minutes in the oven and then removed. The mold is removed from the TEFLON® brick and cooled for 15 minutes. The two copper dishes are then pried off, thereby releasing a liner formed from the reactive material in the desired shape. The liner may be formed into a shape up to several inches thick.

In a fragmentary warhead 10, which comprises fragments 12 of reactive material, the reactive material may be processed into the desired fragment shapes by extrusion or pressing. These reactive fragments 12 may have a thickness up to several inches thick. The dimensions of a liner 8 or reactive fragments 12 may vary, depending on the application in which the reactive material is being used. Therefore, each application may require optimization testing.

The reactive material of the present invention may be deposited in the warhead as known in the art. The reactive material may replace the conventional liner 8, such as the copper liner, that is used in penetrating warheads 2. In addition, it is also contemplated that the reactive material may be used in addition to the copper liner. For example, the reactive material may be deposited on top of the copper liner. The reactive material may also be formed into reactive fragments 12 for use in a fragmentary warhead 10. These reactive fragments 12 may be secured in the warhead as known in the art.

The reactive materials of the present invention significantly reduce or eliminate the safety concerns associated with the processing of high density, reactive metals and fluoropolymers. These reactive materials can be processed at dramatically lower temperatures and pressures in comparison to the temperatures and pressures required to process PTFE reactive materials. These reactive materials can also be processed more efficiently because the sintering step necessary to process PTFE is eliminated. The reactive materials also allow near-net-shape fabrication of reactive material components using injection molding or extrusion, thus reducing waste. In addition, waste is eliminated because the reactive material can be readily recycled into new components. Finally, processing of these reactive materials eliminates the use of solvent in the process as they may be mixed or compounded in a twin screw extruder.

EXAMPLE 1

Compositions of Ta/THV 220 and Hf/THV 220 Reactive Materials

The compositions of Ta/THV 220 and Hf/THV 220 reactive materials are shown in Table 2.

TABLE 2

High Density Reactive Material Compositions

| Metal Filler | Fluoropolymer | Filler Density (g/cm3) | Fluoropolymer Density (g/cm3) | Wt % Metal | Wt % Fluoropolymer | Vol % Metal | Vol % Fluoropolymer | Theoretical Maximum Density (g/cm3) |
|---|---|---|---|---|---|---|---|---|
| Tantalum | THV 220 | 16.69 | 1.95 | 71.70 | 28.30 | 22.84 | 77.16 | 5.317 |
| Tantalum | THV 220 | 16.69 | 1.95 | 47.20 | 52.80 | 9.46 | 90.54 | 3.344 |
| Hafnium | THV 220 | 13.30 | 1.95 | 67.00 | 33.00 | 22.94 | 77.06 | 4.554 |
| Hafnium | THV 220 | 13.30 | 1.95 | 52.50 | 47.50 | 13.95 | 86.05 | 3.533 |

EXAMPLE 2

Mixing of Ta/THV 220 and Hf/THV 220 Reactive Materials

The Ta/THV 220 reactive materials were mixed using two techniques, the solvent loss technique and the polymer precipitation technique, to determine which technique provided the best mixing. Two small 10-gram mixes were made using both techniques. In the solvent loss method, the THV 220 was dissolved in acetone. The tantalum was mixed in with the THV 220 while stirring continuously to drive off the acetone. Small chunks of homogeneous, tantalum-filled THV 220 material were produced, which were then dried in a forced-air oven. The solvent loss technique resulted in a well mixed composition of tantalum-filled THV 220. However, one disadvantage of this technique is that solvent is required when the reactive material is produced in batch mixes.

In the polymer precipitation technique, THV 220 was dissolved in acetone and tantalum was mixed into the solution. A non-polar solvent, such as hexane or heptane, was then added to change the polarity of the solution, forcing the THV 220 to precipitate. One advantage of this technique is its increased speed, which reduces the time needed for mixing. In addition, this process works extremely well with reactive materials that have less than 20 percent by volume of the fluoropolymer. However, the high-density Ta/THV 220 and Hf/THV 220 reactive materials contained approximately 70% by volume of THV 220, which resulted in large sticky agglomerates that were hard to process.

Samples of the Ta/THV 220 reactive materials produced by the two techniques were submitted for safety characterization testing. Surprisingly, the safety characteristics of the reactive materials varied with onset temperature sensitivity depending on how the samples were processed. The polymer precipitation technique created a reactive material that was more easily ignited, which may be related to the presence of uncoated tantalum that is extremely thermally unstable in an oxygen atmosphere. The safety characteristics of the Ta/THV 220 reactive materials produced by the solvent loss and polymer precipitation techniques are listed in Table 3.

TABLE 3

Safety Data For Ta/THV 220 Reactive Materials Comparing The Solvent Loss Technique To The Polymer Precipitation Technique

| Composition | Thiokol Impact (cm) | ABL Sliding Friction (lbs@8 ft/s) | Thiokol ESD (Joules) | Simulated Bulk Auto Ignition Onset Temp (° F.) | DSC Onset Temp (° C.) | Thiokol Safety Class |
|---|---|---|---|---|---|---|
| 30.0% THV 220 70.0% Tantalum Solvent Loss | >46 | 800 | >8.0 | Onset 500 F. Burned | 435.2 | Green Line-Safe to Process |
| 30.0% THV 220 70.0% Tantalum Polymer Precip. | >46 | 800 | >8.0 | Onset 500 F. Burned | 360.7 | Green Line-Safe to Process |
| 30.0% THV 220 70.0% Tantalum Solvent Loss | ARC Step Heated to 350° C., Ignited | | | | | |
| 30.0% THV 220 70.0% Tantalum Polymer Precip. | ARC: 5 gram sample isothermally aged at 250° C., ignited after 6 hours | | | | | |

Based on the safety data for the Ta/THV 220 reactive material and the processing issues involved with the polymer precipitation technique, the solvent loss technique was used to produce subsequent Ta/THV 220 and Hf/THV 220 reactive materials. A total of 3×1000 -gram mixes were made with tantalum and hafnium, respectively.

EXAMPLE 3

Additional Compositions of Reactive Materials Comprising Fluoropolymers and Metal Fillers Reactive materials comprising one of THV 220, THV X 310, THV 415, THV 500, or HTEX 1510 as the fluoropolymer and one of tantalum, hafnium, aluminum, magnesium, tungsten, titanium, or zirconium as the metal filler are produced as described in Examples 1 and 2. For each reactive material, the weight percentage of fluoropolymer and metal filler is determined as known in the art.

EXAMPLE 4

Thermal Stability Testing on Ta/THV 220 And Hf/THV 220 Reactive Materials

Thermal stability tests were performed on samples of the Ta/THV 220 and the Hf/THV 220 reactive materials. All samples were placed into sealed one-inch diameter, spherical titanium bombs with a ¼-inch stem. Four runs were made on the Ta/THV 220 mixes as described below:

1. Step heat run, 50–580° C., 5° C. steps, 70% Ta/30% THV 220 Mix #4 (#909), 0.33 grams;
2. 250° C./24 hour isothermal age run, "isotracked" mode, Ta/THV 220 1791-64-1, 5.11 grams;
3. 200° C./24 hour isothermal age run, "isofixed" mode, 70% Ta/30% THV 220 Solvent Loss 1665-74-1, 1.52 grams; and
4. 200° C./24 hour isothermal age run, "isofixed" mode, 70% Ta/30% THV 220 Solvent Loss 1665-74-1, 5.27 grams.

In ARC isothermal aging, the difference between the "isotracked" and "isofixed" modes was that during the "isotracked" mode, the calorimeter walls tracked the bomb temperature during the entire course of the run. In the "isofixed" mode, the calorimeter walls remained at the isothermal age temperature until the sample self-heated beyond the isothermal age temperature plus an "isothermal window" (approximately 2° C). When the isothermal window was exceeded and the self-heat rate exceeded the preset threshold (0.020° C./minute for all tests reported) the walls of the calorimeter began to track the bomb.

The "isofixed" algorithm was used for isothermal aging on the original ARC. The disadvantage to the "isotracked" mode was that the calorimeter was more likely to drift and even registered false exotherms during a long isothermal age run. Long-term temperature stability was better with the classic "isofixed" aging mode. Since some positive temperature drift problems were experienced in the "isotracked" mode, all remaining experiments were conducted in the "isofixed" mode.

Figure 2:
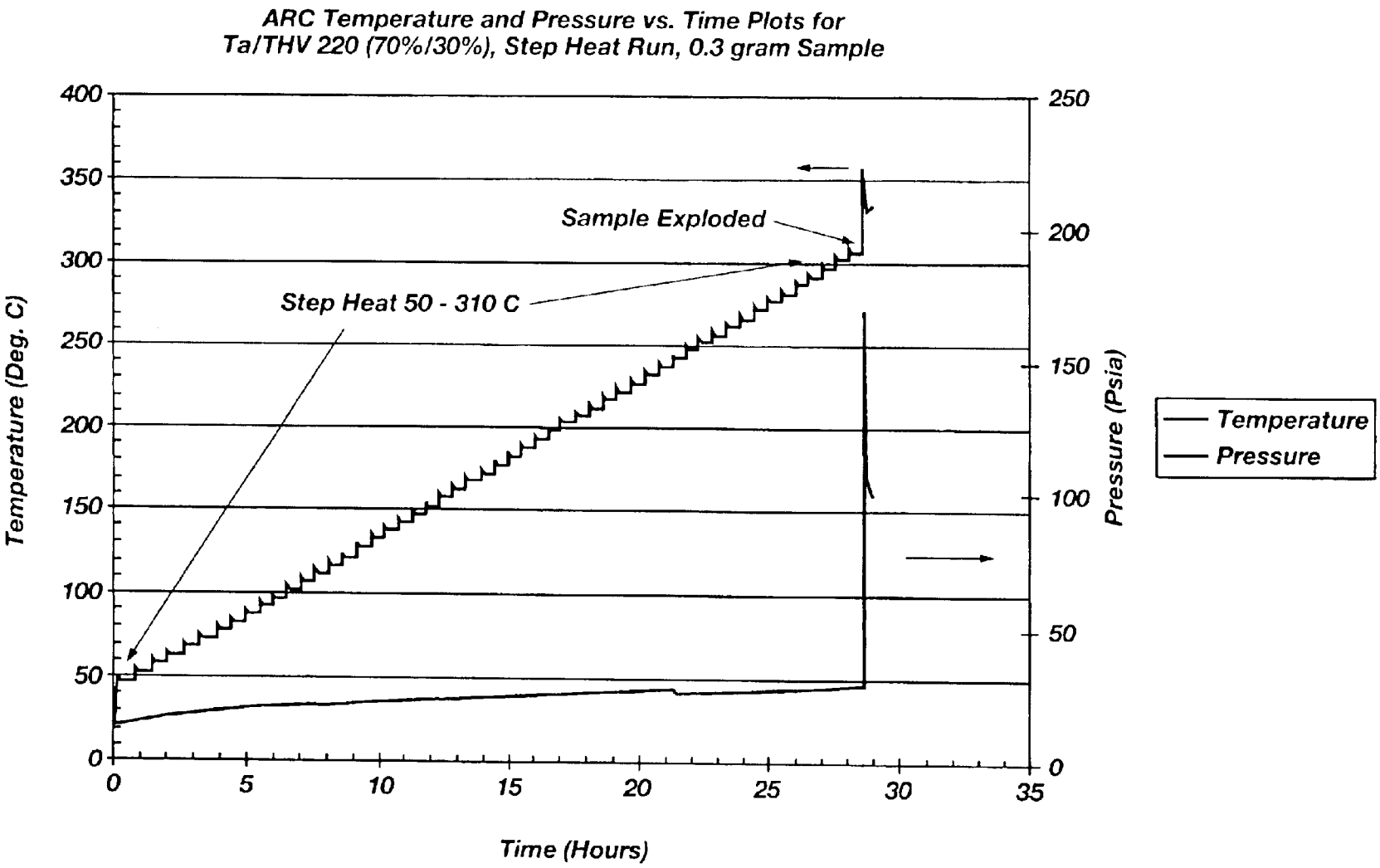
FIG. 2 shows ARC temperature and pressure v. time plots for a step heat run performed on a composition of Ta/THV 220.

The results of the Ta/THV 220 step heat run on a 0.3267 gram sample are shown in FIG. 2. No exotherms (self-heat rates in excess of 0.02° C./minute) were observed up to roughly 310° C. For purposes of these experiments, exotherms were defined as self-heat rates in excess of 0.02° C./minute. However, it is to be understood that this definition may vary, as known in the art, depending on the safety protocol used. Upon heating to 310° C., the sample exothermed and apparently exploded during the wait period. However, 310° C. is significantly above the temperatures that will be used to process the Ta/THV 220 reactive materials. One would expect to detect the exotherm at lower temperatures with larger samples, which better simulate a true bulk thermal runaway, but unfortunately these could not be allowed to autoignite because bomb rupture would occur.

Figure 3:
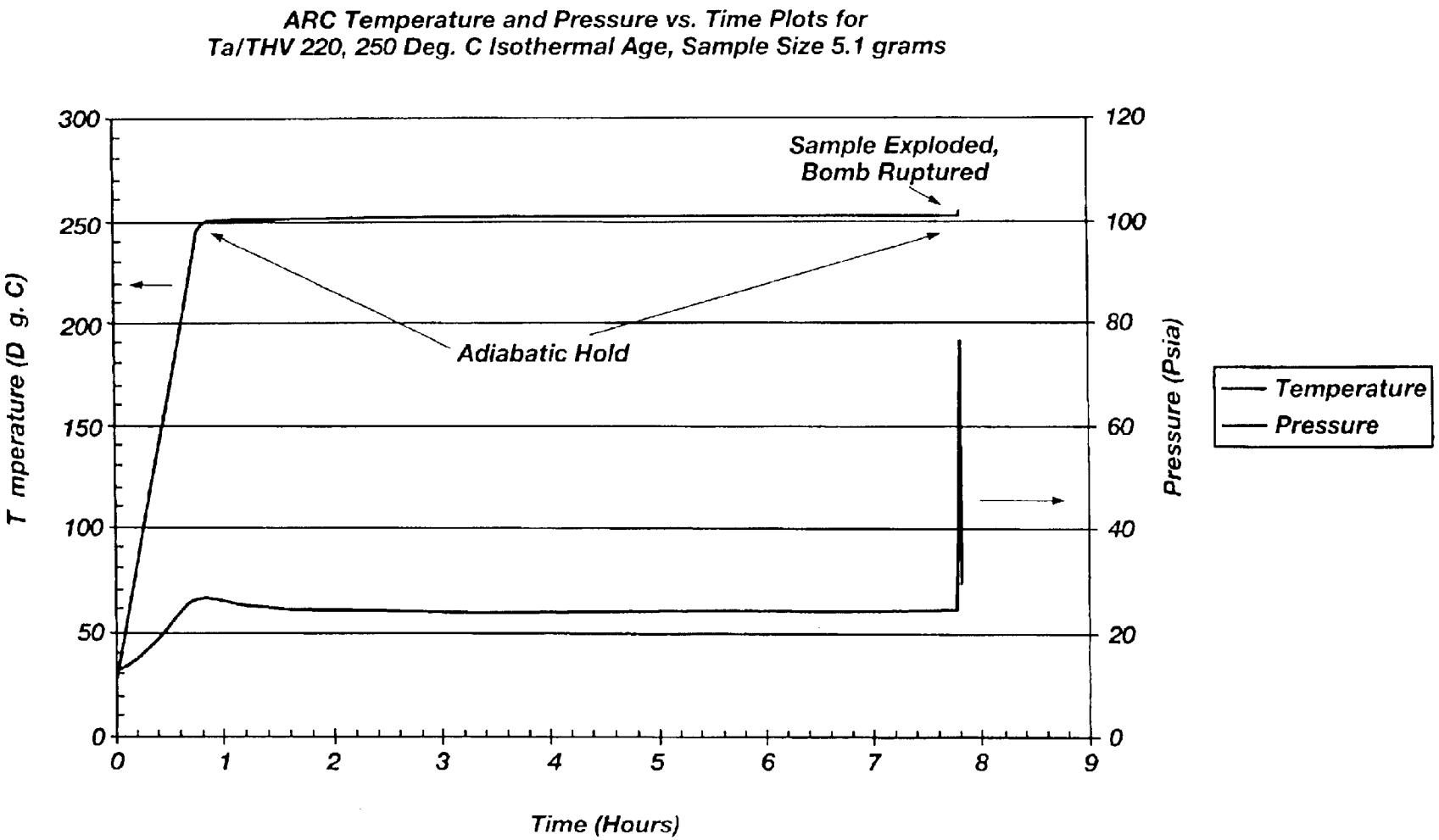
FIG. 3 shows ARC temperature and pressure v. time plots for a 250° C./24 hour isothermal age run performed on a composition of Ta/THV 220.

The 250° C./24 hour isothermal age run was performed on the Ta/THV 220 reactive material (using a different sample than the original run, possibly with different thermal stability characteristics) on a 5.1143 gram sample. This sample size was large enough to provide a good simulation of a bulk sample. Also, isothermal aging did a better job than step heating of unmasking initially slow autocatalytic reactions that can lead to a sudden thermal runaway. FIG. 3 shows the temperature versus time behavior of this sample, which autoignited after less than seven hours at 250° C. This temperature is also significantly above the temperatures that will be used to process the Ta/THV 220 reactive materials.

Figure 4:
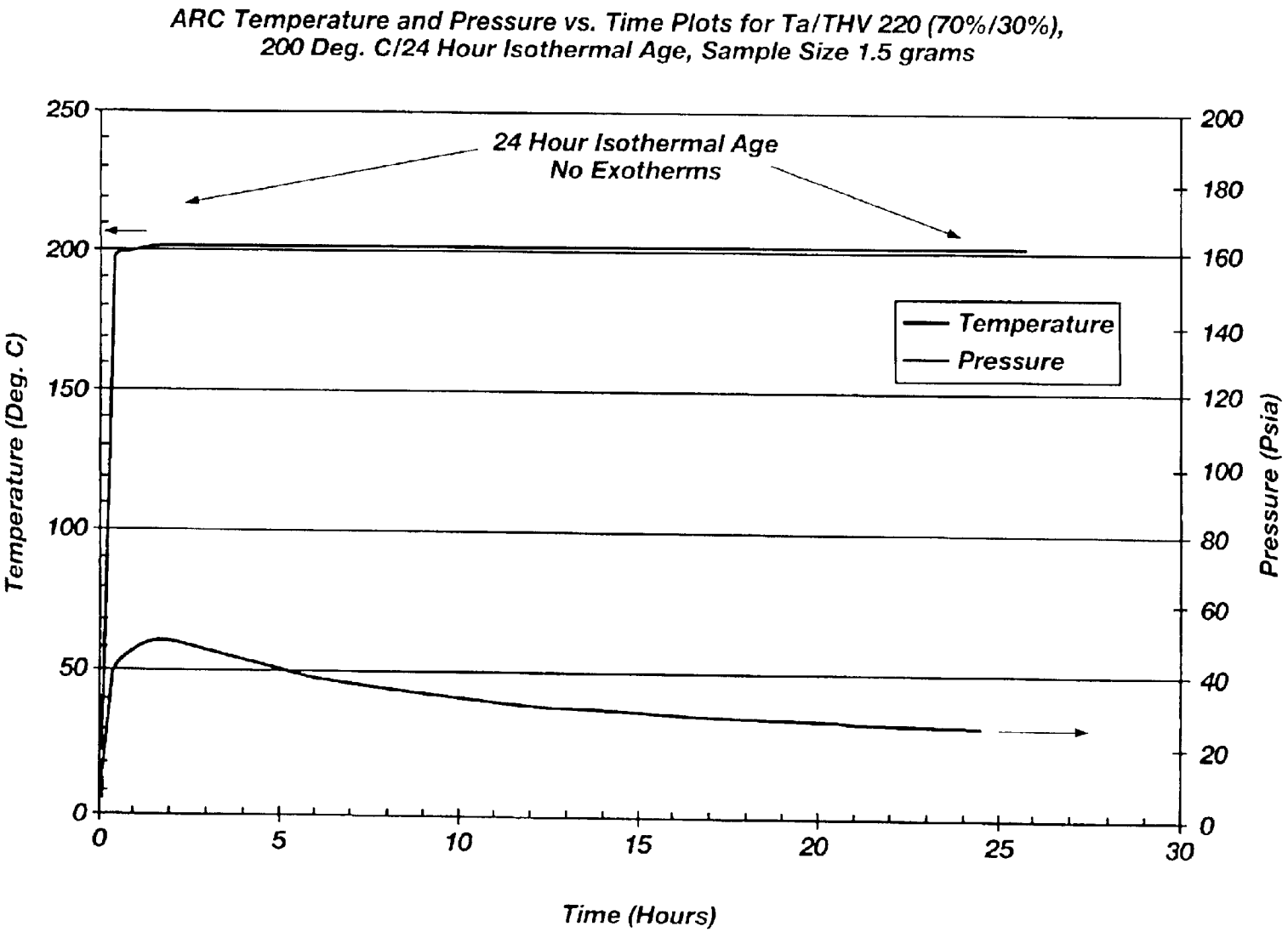
FIGS. 4 and 5 show ARC temperature and pressure v. time plots for a 200° C./24 hour isothermal age run performed on different sample sizes of a composition of Ta/THV 220.
Figure 5:
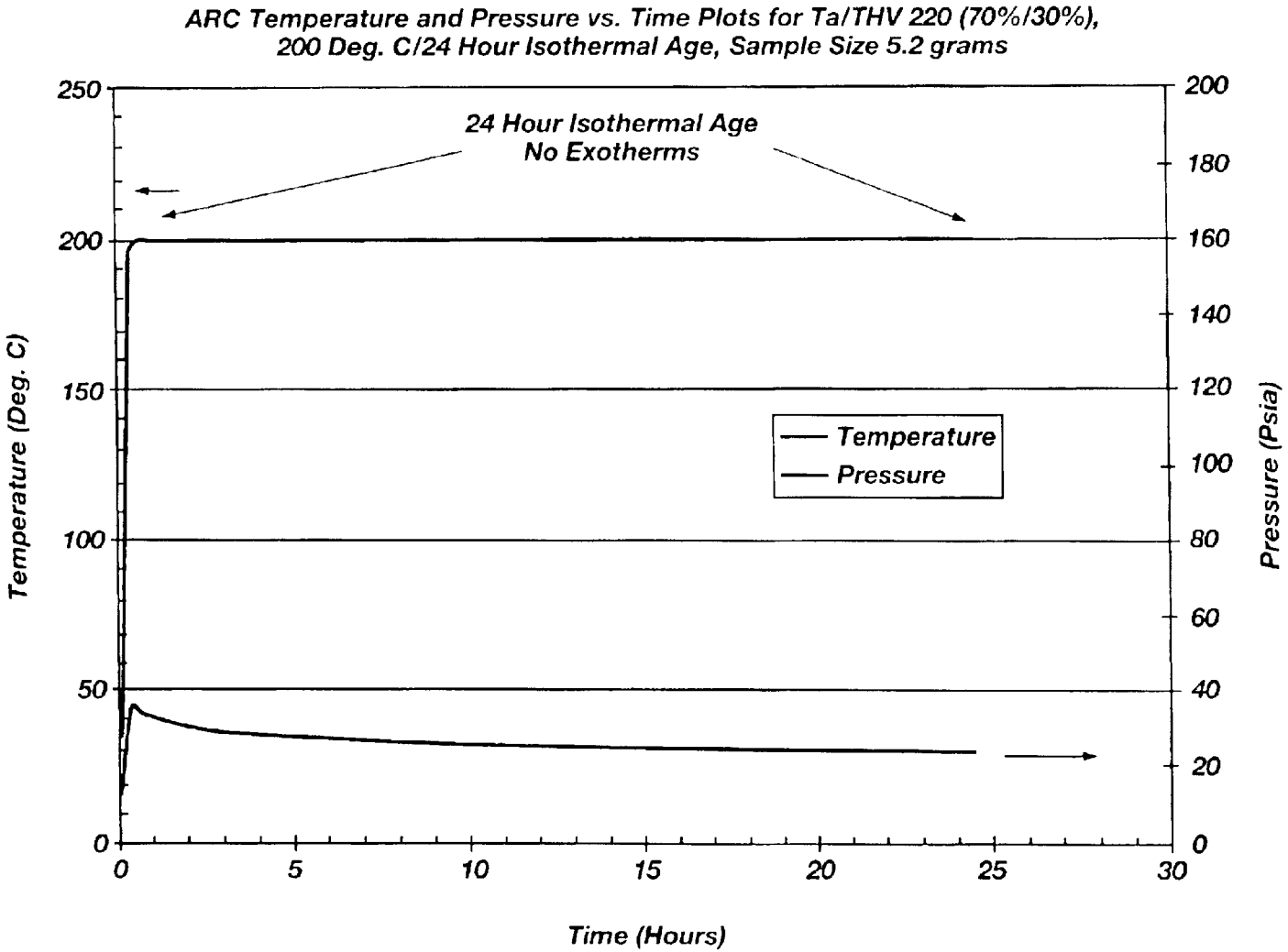

Two additional isothermal age runs were conducted on a different sample (a solvent loss process) at a lower temperature, 200° C., for 24 hours, using progressively larger samples (1.5191 grams, then 5.267 grams). These results are shown in FIGS. 4 and 5. No exotherms (self-heat rates in excess of 0.02° C./minute) were detected with either sample. The 1.5 gram sample showed a slight temperature rise at the start of the run, which may have been due to calorimeter drift. The second run using a 5.3 gram sample did not show this behavior. This temperature is also above the temperatures that will be used to process the Ta/THV 220 reactive materials.

For the Hf/THV 220, two runs were made:

1. step heat run, 50–580° C., 5° C. steps, 70% Hf/30% THV 220 1791–66–1 #1065, 0.31 gram sample; and
2. 200° C./24 hour isothermal age run, 70% HUf/30% THV 220 1791-66-1 #1065, 5.16 gram sample.

Figure 6:
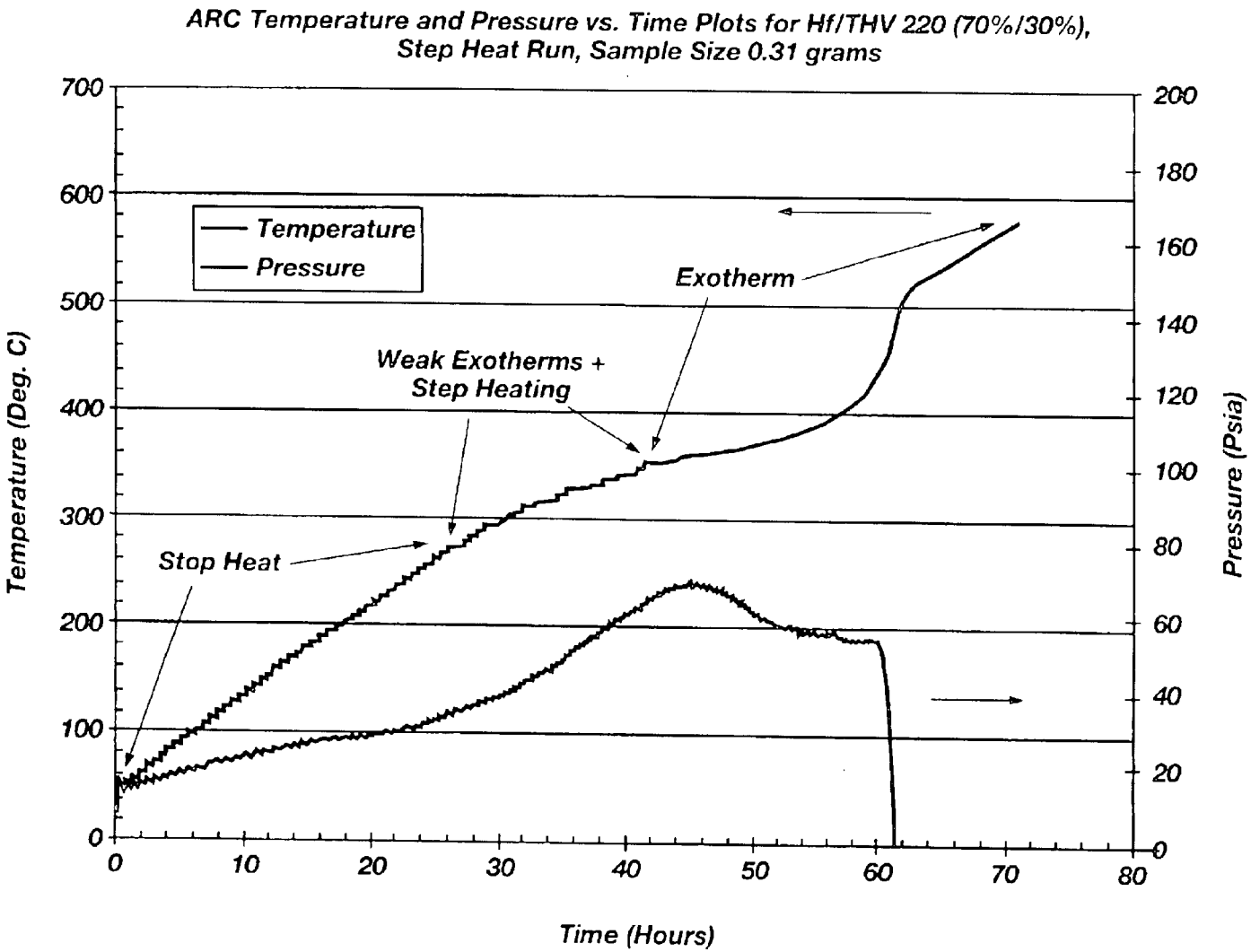
FIG. 6 shows ARC temperature and pressure v. time plots for a step heat run performed on a composition of Hf/THV 220.
Figure 7:
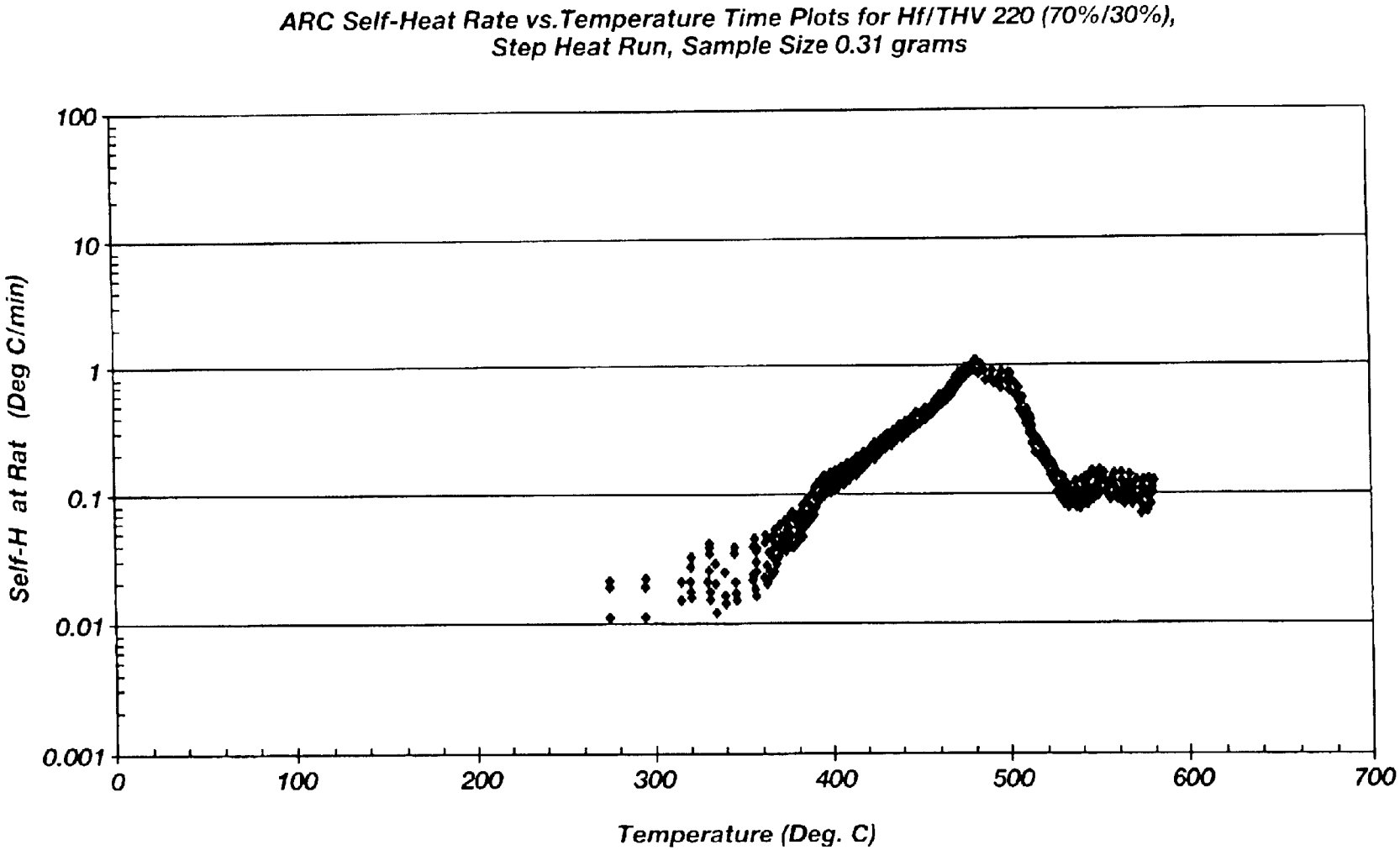
FIG. 7 shows ARC self-heat rate v. temperature plots for a step heat run performed on a composition of Hf/THV 220.

FIGS. 6 and 7 show the temperature/pressure v. time and self-heat rate v. temperature curves respectively for a small (0.3109 gram) sample of Hf/THV 220 reactive material. Starting at about 275° C., there were several small exotherms with self-heat rates near the exotherm threshold (0.020° C./min) that were not sustained. When the self-heat rate dropped below the exotherm threshold, step heating resumed, which happened several times between 275 and 355° C. At 355° C., a sustained exotherm was finally observed. However, 355° C. is significantly above the temperatures that will be used to process the Hf/THV 220 reactive materials. The lower temperature exothermic behavior may have had a contribution from calorimeter drift. It is also unclear what happened to the pressure trace on this run at high temperatures.

Figure 8:
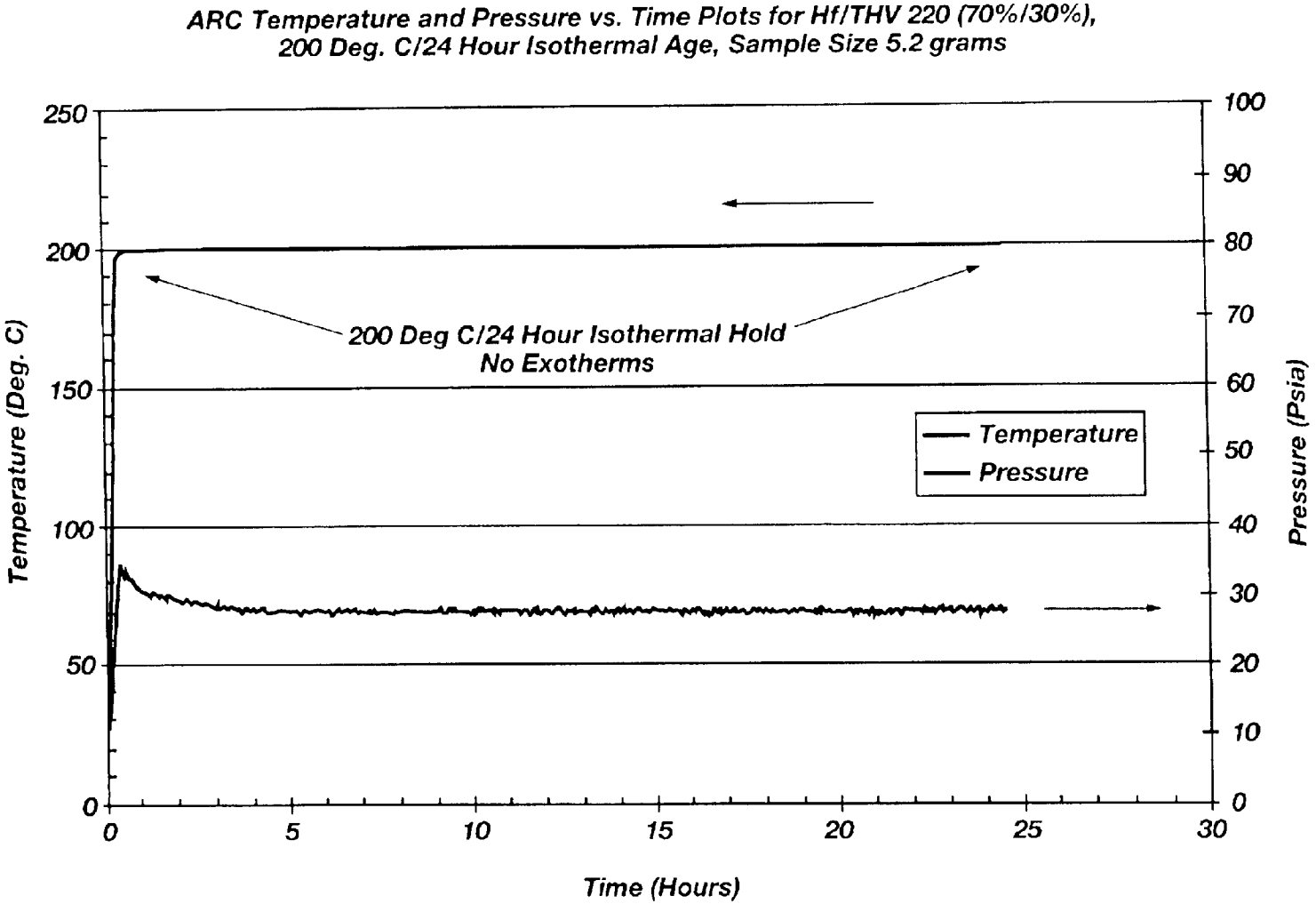
FIG. 8 shows thermal stability results for a 200° C./24 hour isothermal age run performed on a composition of Hf/THV 220.

Finally, a 200° C./24 hour isothermal age experiment was conducted on a 5.17 gram sample of material. As shown in FIG. 8, no appreciable self-heating or exothermic behavior was observed at this temperature.

The results of these stability tests on the Ta/THV 220 and Hf/THV 220 reactive materials indicated that no thermal hazard potential exists for the proposed extrusion involving short-term exposure of the Ta/THV 220 (solvent loss process) and Hf/THV 220 reactive materials to temperatures of approximately 140° C. In fact, both reactive materials were thermally stable at temperatures of approximately 200° C.

EXAMPLE 5

Thermal Stability Testing on Additional Compositions of Reactive Materials Comprising Fluoropolymers and Metal Fillers Reactive materials produced according to Example 3 are evaluated for thermal stability according to Example 4. Thermal stability tests are performed as described in Example 4.

Reactive materials are obtained that have no thermal hazard potential for the proposed extrusion involving short-term exposure of these reactive materials to temperatures slightly greater than the melt temperature of the specific fluoropolymers used in the composition.

EXAMPLE 6

Processing of Ta/THV 220 and Hf/THV 220 Reactive Materials

The mixed Ta/THV 220 and Hf/THV 220 reactive materials were processed by pressing or ram extrusion. The two methods were evaluated to determine whether the method of processing affected the reactive material. Initially, the reactive material was pressed into right circular cylinders and evaluated and eliminated for safety reasons due to the large amount of flashing produced when small samples of inert THV 220 (NaCl/THV 220 and KCl/THV 220) compositions were pressed. Pressing the Al/THV 220, Ta/THV 220 and Hf/THV 200 reactive materials while they were being melted potentially presented a safety hazard due to the flashing formed around the pressing ram. Coupled with the fact that the tantalum and hafnium metal fillers are extremely sensitive to electrostatic discharge ("ESD"), ram extrusion was pursued as the processing technique. By using extrusion, flashing is eliminated, exposure of personnel to the reactive materials is minimized, and safety is improved.

Ram extrusion was used to fabricate 1.1-inch diameter cylinders because the extrusion produced reactive material with low void content, thereby yielding high-density reactive material close to the theoretical maximum density. With both the Ta/THV 220 and Hf/THV 220 reactive materials, multiple extrusions were performed with quantities restricted by volumetric limitations. On average, each extrusion produced enough material to make six 1.1-inch cylinders with very few voids. Unconsolidated reactive material was loaded into the top of the extruder barrel and heated under vacuum until it melted. Pressure was then applied to the ram, which forced the soft reactive material through the die and formed a cylindrical extrudate. As the extrudate grew in length, it eventually contacted a conveyor, which applied backpressure. The backpressure caused the extrudate to bulge near the die where the extrudate was still soft. The resulting extrudates therefore had sections of varying diameter.

Visual inspection of the extruded Hf/THV 220 reactive material showed the presence of shiny specks randomly dispersed in the material. This was compared to the extruded Ta/THV 220 reactive material, where no specks were present. The shiny specs in the Hf/THV 220 extrudates were believed to be uncoated particles of Hf.

The processed Ta/THV 220 and Hf/THV 220 extrudates were evaluated to determine the % of TMD for each sample.

EXAMPLE 7

Processing of Additional Compositions of Reactive Materials Comprising Fluoropolymers and Metal Fillers Reactive materials comprising the metal fillers and fluoropolymers described in Example 3 are processed as described in Example 6.

The extrudates from these processed reactive materials are evaluated to determine the % of TMD for each sample.

EXAMPLE 8

TMD Values of Ta/THV 220 Extrudates

The % of TMD values for the Ta/THV 220 extrudates were calculated and are presented in Table 4.

TABLE 4

Ta/THV 220 TMD Data

| Testing Date | Sample Position | Density (g/cc) | % of TMD |
|---|---|---|---|
| Jan. 21, 2002 | Middle of Rod | 5.256 | 98.86 |
| Feb. 4, 2002 | End of Delivered Rod | 5.281 | 99.32 |

TABLE 4-continued

Ta/THV 220 TMD Data

| Testing Date | Sample Position | Density (g/cc) | % of TMD |
|---|---|---|---|
| Feb. 4, 2002 | Middle of Rod | 5.254 | 98.81 |
| Feb. 4, 2002 | Middle of Rod | 5.281 | 99.32 |
| Feb. 4, 2002 | End of Delivered Rod | 5.275 | 99.21 |
| | Average | 5.269 | 99.106 |

As shown in Table 4, these Ta/THV 220 extrudates had TMD values ranging from 98.81–99.32%, with an average TMD value of 99.106%. These TMD values are significantly higher than the average TMD value for W/PTFE, which was determined to be approximately 96% (data not shown). These TMD values are also higher than the TMD values for Al/THV 220, which were determined to range from approximately 97.9%–99.2% (data not shown).

EXAMPLE 9

TMD Values For Hf/THV 220 Extrudates

The % of TMD values for the Hf/THV 220 extrudates were calculated and are presented in Table 5. When hafnium was used as the metal filler, the extrudate density was not as close to the % of TMD as the Ta/THV 220 extrudates. The lower % of TMD may be related to changes in the reactive material's rheology or poor bonding of the THV 220 to the surface of the hafnium powder. As previously mentioned, the Hf/THV 220 extrudates comprised small shiny specks that were believed to be uncoated Hf particles. The lower density values of the Hf/THV 220 extrudate support this observation because the uncoated Hf would result in microscopic voids in the material, thereby reducing the % of TMD.

TABLE 5

Hf/THV 220 TMD Data

| Testing Date | Sample Position | Density (g/cc) | % of TMD |
|---|---|---|---|
| Feb. 4, 2002 | End of Delivered Rod | 4.427 | 97.21 |
| Feb. 4, 2002 | End of Delivered Rod | 4.440 | 97.49 |
| Feb. 4, 2002 | End of Delivered Rod | 4.450 | 97.71 |
| Feb. 4, 2002 | End of Delivered Rod | 4.444 | 97.58 |
| | Average | 4.440 | 97.50 |

The TMD values for the Hf/THV 220 reactive materials are slightly lower than the TMD values for the Ta/THV 220 reactive materials. However, the % of TMD for the Hf/THV 220 reactive materials are higher than the average TMD value for W/PTFE, which was determined to be approximately 96% (data not shown). These TMD values are also comparable to the TMD values for Al/THV 220, which were determined to range from approximately 97.9%–99.2% (data not shown).

EXAMPLE 10

TMD Values for Additional Compositions of Reactive Materials Comprising Fluoropolymers and Metal Fillers The % of TMD values for the reactive materials comprising the metal fillers and fluoropolymers described in Example 3 are measured. Reactive materials that have TMD values greater than the average TMD value for W/PTFE are obtained. The average TMD value for W/PTFE was determined to be approximately 96% (data not shown).

EXAMPLE 11

Penetration Ability of Ta/THV 220 and Hf/THV 220 Reactive Materials

The Ta/THV 220 and Hf/THV 220 reactive materials exhibited improved penetration into solid targets compared to the Ta/PTFE and W/PTFE reactive materials (data not shown).

EXAMPLE 12

Penetration Ability of Additional Compositions of Reactive Materials Comprising Fluoropolymers and Metal Fillers Reactive materials comprising the metal fillers and fluoropolymers described in Example 3 are obtained. These reactive materials have improved penetration into solid targets compared to the Ta/PTFE and W/PTFE reactive materials.

What is claimed is:

1. A composition for a reactive material, comprising:

an oxidizing agent comprising a fluoropolymer selected from the group consisting of a thermoplastic terpolymer of tetrafluoroethylene, hexafluoropropylene, and vinylidene fluoride, a thermoplastic copolymer of tetrafluoroethylene and perfluorovinylether, a thermoplastic copolymer of tetrafluoroethylene and ethylene, and a thermoplastic copolymer of tetrafluoroethylene and hexafluoropropylene; and at least one metal filler.

2. The composition of claim 1, wherein the fluoropolymer is present in the reactive material at approximately 15–90% by weight.

3. The composition of claim 1, wherein the fluoropolymer is present in the reactive material at approximately 25–75% by weight.

4. The composition of claim 1, wherein the oxidizing agent has a fluorine content of greater than approximately 45% by weight.

5. The composition of claim 1, wherein the at least one metal filler comprises a metal having a density approximately equal to or greater than the density of magnesium.

6. The composition of claim 1, wherein the at least one metal filler is present in the reactive material at approximately 10–85% by weight.

7. The composition of claim 1, wherein the at least one metal filler is selected from the group consisting of magnesium, aluminum, magnesium/aluminum alloys, iron, copper, zirconium, titanium, zinc, manganese, tin, boron, silicon, hafnium, tungsten, depleted uranium, and tantalum, and metal carbides, oxides, and nitrides thereof.

8. The composition of claim 1, wherein the at least one metal filler is a metal/metal oxide thermite or a metal/metal intermetallic.

9. The composition of claim 1, wherein a processing temperature of the reactive material is substantially below a thermal autoignition temperature of the reactive material.

10. An article comprising a liner formed from a reactive material, the reactive material, comprising:

an oxidizing agent comprising a fluoropolymer selected from the group consisting of a thermoplastic terpolymer of tetrafluoroethylene, hexafluoropropylene, and vinylidene fluoride, a thermoplastic copolymer of tetrafluoroethylene and perfluorovinylether, a thermoplastic copolymer of tetrafluoroethylene and ethylene, and a thermoplastic copolymer of tetrafluoroethylene and hexafluoropropylene; and at least one metal filler.

11. The article of claim 10, wherein the at least one metal filler comprises a metal having a density approximately equal to or greater than the density of magnesium.

12. The article of claim 10, wherein the at least one metal filler is selected from the group consisting of magnesium, aluminum, magnesium/aluminum alloys, iron, copper, zirconium, titanium, zinc, manganese, tin, boron, silicon, hafnium, tungsten, depleted uranium, and tantalum, and metal carbides, oxides, and nitrides thereof.

13. The article of claim 10, wherein the at least one metal filler is a metal/metal oxide thermite or a metal/metal intermetallic.

14. The article of claim 10, wherein the at least one metal filler is present in the reactive material at approximately 10–85% by weight.

15. The article of claim 10, wherein a processing temperature of the reactive material is substantially below a thermal autoignition temperature of the reactive material.

16. The article of claim 10, wherein the fluoropolymer is present in the reactive material at approximately 15–90% by weight.

17. The ice of claim 10, wherein the fluoropolymer is present in the reactive material at approximately 25–75% by weight.

18. A method of processing a reactive material, comprising:

mixing at least one metal filler with an oxidizing agent to form a reactive material, the oxidizing agent comprising a fluoropolymer selected from the group consisting of a thermoplastic terpolymer of tetrafluoroethylene, hexafluoropropylene, and vinylidene fluoride, a thermoplastic copolymer of tetrafluoroethylene and perfluorovinylether, a thermoplastic copolymer of tetrafluoroethylene and ethylene, and a thermoplastic copolymer of tetrafluoroethylene and hexafluoropropylene; and processing the reactive material at a temperature that does not exceed a thermal autoignition temperature of the reactive material.

19. The method of claim 18, wherein mixing at least one metal filler with an oxidizing agent comprises mixing the at least one metal filler selected from the group consisting of magnesium, aluminum, magnesium/aluminum alloys, iron, copper, zirconium, titanium, zinc, manganese, tin, boron, silicon, hafnium, tungsten, depleted uranium, and tantalum, and metal carbides, oxides, and nitrides thereof, with the oxidizing agent.

20. The method of claim 18, wherein mixing at least one metal filler with an oxidizing agent comprises mixing at least one metal/metal oxide with the oxidizing agent.

21. A method of processing a reactive material, comprising:

mixing a metal filler with an oxidizing agent to form a reactive material, the oxidizing agent comprising a fluoropolymer selected from the group consisting of a thermoplastic terpolymer of tetrafluoroethylene, hexafluoropropylene, and vinylidene fluoride, a thermoplastic copolymer of tetrafluoroethylene and perfluorovinylether, a thermoplastic copolymer of tetrafluoroethylene and ethylene, and a thermoplastic copolymer of tetrafluoroethylene and hexafluoropropylene; and processing the reactive material at a temperature substantially below a thermal autoignition point of the reactive material.

22. An artillery projectile comprising a liner formed from a reactive material, the reactive material comprising:

an oxidizing agent comprising a fluoropolymer selected from the group consisting of a thermoplastic terpolymer of tetrafluoroethylene, hexafluoropropylene, and vinylidene fluoride, a thermoplastic copolymer of tetrafluoroethylene and perfluorovinylether, a thermoplastic copolymer of tetrafluoroethylene and ethylene, and a thermoplastic copolymer of tetrafluoroethylene and hexafluoropropylene; and at least one metal filler.

23. A warhead comprising fragments or a liner formed from a reactive material, the reactive material comprising:

an oxidizing agent comprising a fluoropolymer selected from the group consisting of a thermoplastic terpolymer of tetrafluoroethylene, hexafluoropropylene, and vinylidene fluoride, a thermoplastic copolymer of tetrafluoroethylene and perfluorovinylether, a thermoplastic copolymer of tetrafluoroethylene and ethylene, and a thermoplastic copolymer of tetrafluoroethylene and hexafluoropropylene; and at least one metal filler.

24. A warhead for use in a projectile, comprising:

a case;

an explosive material;

an initiator; and a liner or fragments, the liner or fragments formed from a reactive material comprising at least one metal filler and an oxidizing agent, wherein the oxidizing agent comprises a fluoropolymer selected from the group consisting of a thermoplastic terpolymer of tetrafluoroethylene, hexafluoropropylene, and vinylidene fluoride, a thermoplastic copolymer of tetrafluoroethylene and perfluorovinylether, a thermoplastic copolymer of tetrafluoroethylene and ethylene, and a thermoplastic copolymer of tetrafluoroethylene and hexafluoropropylene.

* * * * *

UNITED STATES PATENT AND TRADEMARK OFFICE

CERTIFICATE OF CORRECTION

PATENT NO. : 6,962,634 B2
APPLICATION NO. : 10/386617
DATED : November 8, 2005
INVENTOR(S) : Daniel B. Nielson, Richard M. Truitt and Nikki Rasmussen It is certified that error appears in the above-identified patent and that said Letters Patent is hereby corrected as shown below:

On the title page:

In ITEM (54) Title: change "LOW TEMPERATURE, EXTRUDABLE, HIGH DENSITY REACTIVE MATERIALS" to --LOW TEMPERATURE, EXTRUDABLE, HIGH-DENSITY REACTIVE MATERIALS--

In the specification:

COLUMN 1, LINES 1,2 change "LOW TEMPERATURE, EXTRUDABLE, HIGH DENSITY REACTIVE MATERIALS" to --LOW TEMPERATURE, EXTRUDABLE, HIGH-DENSITY REACTIVE MATERIALS--

In the claims:

CLAIM 17, COLUMN 17, LINE 28, change "The ice of claim 10," to --The article of claim 10--

Signed and Sealed this

Twenty-seventh Day of January, 2009

John Doll

JOHN DOLL
*Acting Director of the United States Patent and Trademark Office*